US006745951B2

(12) United States Patent
Barykin et al.

(10) Patent No.: US 6,745,951 B2
(45) Date of Patent: Jun. 8, 2004

(54) HIGH FREQUENCY PULSE RATE AND HIGH PRODUCTIVITY DETONATION SPRAY GUN

(75) Inventors: Georgy Yur'evich Barykin, Irun (ES); Iñaki Fagoaga Altuna, Irun (ES)

(73) Assignee: Aerostar Coatings, S.L., Irun (ES)

( * ) Notice: Subject to any disclaimer, the term of this patent is extended or adjusted under 35 U.S.C. 154(b) by 0 days.

(21) Appl. No.: 10/135,020

(22) Filed: Apr. 23, 2002

(65) Prior Publication Data

US 2002/0130201 A1 Sep. 19, 2002

Related U.S. Application Data

(63) Continuation of application No. PCT/ES99/00349, filed on Oct. 28, 1999.

(51) Int. Cl.[7] ..... B05B 1/24

(52) U.S. Cl. ..... 239/85; 239/79; 239/81; 239/400; 239/419.3; 239/427; 239/433

(58) Field of Search ..... 239/79, 81, 85, 239/400, 419.3, 419, 427, 433, 128, 427.3

(56) References Cited

U.S. PATENT DOCUMENTS

| | | | | |
|---|---|---|---|---|
| 3,004,822 A | | 10/1961 | Poorman et al. | |
| 3,910,494 A | | 10/1975 | Melton, Jr. | |
| 4,004,735 A | | 1/1977 | Zverev et al. | |
| 4,231,518 A | | 11/1980 | Zverev et al. | |
| 4,319,715 A | * | 3/1982 | Garda et al. | 239/81 |
| 4,669,658 A | | 6/1987 | Nevgod et al. | |
| 4,687,135 A | * | 8/1987 | Nevgod et al. | 239/400 |
| 5,019,686 A | * | 5/1991 | Marantz | 239/81 |
| 5,542,606 A | * | 8/1996 | Kadyrov et al. | 239/81 |

FOREIGN PATENT DOCUMENTS

| | | |
|---|---|---|
| WO | WO 99/12653 | 3/1999 |

* cited by examiner

*Primary Examiner*—Steven J. Ganey
(74) *Attorney, Agent, or Firm*—Katten Muchin Zavis Rosenman

(57) ABSTRACT

A detonation gun for thermal spraying formed by a combustion chamber (1) and a barrel (2), with entrances for fuel (5) and for oxidizer (4), one or more spark plugs (6) for detonating the fuel-oxidizer mixture and one or more injectors (7) for the introduction of the product into the barrel, the gun in the invention centers its characteristics on the incorporation of a direct injection system of the fuel and oxidizer gases into the explosion chamber, producing explosive mixtures of different compositions according to the various zones in the explosion chamber, with a constrained volume existing in this explosion chamber in which only fuel is injected in such a way that it can generate high-energy explosions, maintaining the cyclic operation of the gun. The gun also incorporates in the barrel (2–2'), one or more annular injectors (7), which allow the feeding of various products, and especially coating powder, so that it is possible to increase the number of kilograms deposited on the substrate per unit of time and, in consequence, the gun's productivity.

12 Claims, 4 Drawing Sheets

HIGH FREQUENCY PULSE RATE AND HIGH PRODUCTIVITY DETONATION SPRAY GUN

This application is a continuation of PCT/ES99/00349 filed on Oct. 28, 1999.

OBJECT OF THE INVENTION

This invention refers to a spray gun, of the type used in the industrial thermal spray area for obtaining coatings, especially in detonation spray technologies.

The object of the invention is to achieve a new detonation gun with greater productivity than existing ones, maintaining stable and continued optimum spray conditions in each firing cycle. In relation to previous detonation devices, this gun allows the firing frequency to be increased, together with the amount of powder and feeder gases and in consequence, the amount of coating powder deposited per unit of time, maintaining optimum levels of quality that are characteristic of coating produced by detonation technologies.

For this purpose, a new gas feeding system is proposed, in a new explosion chamber, that permits the gun's operating frequency to be increased, making it possible to maintain the optimized characteristics of each explosion stable and constant, even at high frequencies and a new system for feeding products in the barrel that allows the distributed injection of products to any point within the barrel achieving an increase of the amount of powder injected into the barrel and reducing the limitations associated with obstruction of feeder ducts, together with great operating versatility by being able to select the injection point.

The barrel feeding system, in addition to the coating powder, it is also useful to introduce other products that can condition the thermal spray process, in this way permitting great flexibility when modifying the operating parameters, by being able to modify the characteristics of the generated explosions and to improve and optimize the coatings obtained in this way.

It is also an object of the invention to achieve better performance from the gun, based on thermally isolating the gases produced in the explosive process with respect to the cooled barrel wall, in order to obtain better use of the energy that is carried by these gases, with the resulting increase in the gun's performance and its efficiency.

BACKGROUND TO THE INVENTION

Current detonation spray technologies are mainly used for the application of coatings to parts that are subject to severe conditions of wear, heat or corrosion, and which are fundamentally based on the use of the thermal and kinetic energy produced by the explosion of a gaseous mixture to deposit a coating material powder on these parts.

The coating materials that are usually employed in detonation spray processes include metallic powder, metal-ceramics and ceramics etc, and are applied to improve the resistance to wear, erosion, corrosion and as thermal insulators or as electrical insulators or conductors, among other applications as given in the literature.

Detonation spray is performed with spray guns that basically consist of a tubular explosion chamber with one end closed and the other open, to which a barrel, also tubular, is connected. The explosive gases are injected inside the explosion chamber and ignition of the gas mixture is produced by means of a spark plug, which provokes an explosion and in consequence, a shock or pressure wave that reaches supersonic speeds during its propagation inside the barrel until it leaves the open end.

The coating material powders are usually injected inside the barrel in contact with the explosive mixture so that they are dragged along by the propagating shock wave and by the set of gaseous products from the explosion, which are expulsed at the end of the barrel, and deposited on a substrate or part that has been placed in front of the barrel. This impact of the coating powders on the substrate produces a high density coating with elevated levels of internal cohesion and adherence to the substrate. This process is repeated in a cyclic manner until the part is suitably coated.

In traditional detonation spray equipment, the gases used in the generation of the explosive process are mixed in a separate chamber prior to the explosion chamber, which is then fed by a homogeneous mixture of gases in each explosive cycle. Traditionally, this pre-mixing chamber is isolated from the explosion chamber during the explosive phase for safety reasons, through the use of valves in one or more gas lines, with and without the introduction of an inert gas between two consecutive explosions.

In other, more advanced types of detonation equipment, presented by the applicant in PCT US96/20160, this isolation between the pre-mix and explosion chambers is achieved by using dynamic valves, which means they do not have any moving parts, which overcomes the inherent disadvantages of the previously-mentioned mechanical systems. However, these devices continue to employ a pre-mixing chamber in order to homogenize the gas composition that feeds the explosion chamber.

Recently, the same applicant developed a type of detonation spray equipment, described in PCT ES97/000223, with a gas injection system that does not employ mechanical valves or systems to shut off the gas supply, and, in addition, allows the gases feeding to be fed directly and separately to the explosion chamber through a series of independent passageways, where each passageway is made up of an expansion chamber and a large number of distributor ducts with reduced cross section and/or long length. This results in a system without any moving mechanical parts and/or pre-mixing chamber. In this device, the expansion chamber for each passageway is in direct communication with the corresponding supply line, while the distributor ducts are suitably arranged so that multiple gas injection points open out on the internal surface of the explosion chamber, producing a continuous and separate feeding at multiple points, which guarantees that the combustible mixture is produced directly and in a homogeneous manner, throughout the entire explosion chamber prior to each ignition and with sufficient flow to fill the chamber in each detonation cycle.

In turn, in the application PCT ES98/00015, also of the same applicant, a powder injection system is described for a detonation spray gun consisting of a dosing chamber directly fed by a conventional type continuous powder feeder that communicates with the barrel by means of a direct duct. In this way, the pressure generated by the explosion and which advances along the barrel, passes through the communication duct and undergoes a brusque expansion on reaching the dosing chamber, which interrupts the powder feeding from the continuous feeder and produces complete fluidization of the powder in the dosing chamber. The fluidized powder is carried by the suction towards the barrel, where the pressure wave generated in a new explosive cycle drags it out and deposits it on the surface to be coated.

The detonation guns of the described type produce coatings of excellent quality, but they have a limitation in so far as the amount of powder that can be deposited per unit of time. This is due to the fact that, for a detonation gun of a determined size, the optimum amount of powder that can be processed during each explosion is limited by the existence of a maximum volume of optimized gaseous mixture that may be processed in each explosion and capable of generating proper characteristics of the actual explosive process itself. An increase in the gaseous volumes involved in each explosion on this maximum volume of optimized mixture is not directly translated into an improvement of the explosive process of each cycle, so that an increase in the amount of powder deposited per unit of time should not be obtained so much because of an increase in the powder processed in each explosion, but as a consequence of the increasing in the firing frequency, guaranteeing optimum explosive characteristics of each cycle in all cases.

On the other hand, the repetition of the explosive cycle at high frequencies and generating explosions with characteristics equivalent to those obtained at lower frequencies also requires higher gas flows in order to guarantee constant gas volumes involved in each explosion. The application of these increments in the gas flows and in the firing frequencies in the previously described equipment produces an increase in the gun's power rating and an increase in the gas supply pressure with an acceleration in the injection and gas mixture processes inside the explosion chamber which causes great difficulty in the maintenance of the actual cyclic detonation process itself, leading to continuous combustion processes and making the spray process impossible with that equipment. In particular, an increase in the gun's power rating and consequently in the gas injection system temperature makes more difficult the cooling of the gases produced in an explosive cycle and which, returning through the injection system ducts allows the cyclic interruption of the supply of oxidizer and fuel to the chamber.

In the equipment described in PCT ES97/00223, the gases, on their return to the explosion chamber, act as an insulating barrier between the gases produced in the prior explosive cycle and the new gas mixture formed in the explosion chamber, preventing self-ignition. However, the operation of this mechanism at high frequencies is made difficult by an increase in the temperature of the explosion chamber, a reduction in the volume of the return gases that acts as an insulating barrier and their rapid return to the explosion chamber, as a result of the greater pressure in the feed lines. In the previously described detonation devices, this leads to the self-ignition of the combustible mixture and the formation of a continuous combustion process.

In currently existing detonation guns as described in this section, there is an additional limitation that derives from the types of powder feeders used since they cannot guarantee the correct fluidity of the powder at high supply speeds. In this sense, it can be seen that current designs are subject to major problems of obstruction and wall deposits on the feeding ducts above a certain amount of injected powder, and this makes continuous and stable operation very difficult. This is mainly due to the geometric aspects of the powder injection devices and/or thermal aspects in relation to the explosive process. In the injection device described in PCT ES98/00015 from the same applicant, the powder is introduced into the barrel through a single orifice, then carried along by the hot gases generated in the explosive cycle. Any increases in the amount of powder, gases and in the operation frequency in order to increase the productivity of the spray process, will soon come up against a limit in the feeding devices, such as that previously stated, since as a consequence of the accumulation of material in a localized area and in the increase of temperature of the gases that interact with the powder in the injector, obstruction and deposit problems as stated before are produced.

On the other hand, there are spray technologies, known as HVOF, that do not produce cyclic explosions, but a continuous combustion that it used in the formation of a supersonic flow of hot gases that are actually employed in the thermal spray process, requiring, in this case, very high gas flow rates for maintaining this required supersonic flow rate for obtaining coatings with a good technical quality.

Due to the continuous nature of the HVOF processes, the more advanced designs of HVOF guns have a powder processing capacity per unit of time that exceeds that achieved with traditional detonation spray systems, although they still have similar problems in the injection of powder, obstruction and deposits inside the spray nozzles.

However, the lower thermodynamic efficiency of the continuous combustion processes against the explosive processes (pulsed or cyclic combustion) leads to the fact that the amounts of gases and power required to deposit the same amount of powder is greater in the HVOF systems, which results in lower performance in resource use and in the introduction of additional operational problems as a consequence of the high working powers employed in the HVOF systems with high processing capability.

It would be therefore, desirable to have a spray gun that employs a pulsed explosive process, with high thermodynamic efficiency in the use of gases and precursor materials, allowing a significant increase in the amount of powder processed per unit of time, and maintaining the typical characteristics of the coating produced by the detonation technologies.

DESCRIPTION OF THE INVENTION

The detonation spray gun of the invention, allows the working at higher frequencies than those employed in currently existing devices with a large volume of powder feeding, achieving greater deposit rates, even when compared with those obtained with current HVOF continuous combustion equipment, but maintaining the higher thermodynamic efficiency of the explosive processes in the use of the gases and precursors, resulting in greater productivity.

The current detonation spray system is based on the generation of explosive gaseous mixtures of different compositions in different zones of the chamber zone, which is due to a specific design of the gas injectors and the explosion chamber, employing dynamic valves and direct, separate injection for fuel and oxidizer, without pre-mixing of both prior to the explosion chamber itself.

First, in order to enable the gun to operate at high frequencies with high gas volumes per explosion, it has been planned for the gas feeding to the explosion chamber to be produced via several points, spatially distributed throughout the explosion chamber, so that gaseous mixtures are generated with locally varying compositions in the various zones inside this chamber, allowing higher energy explosions to be generated at higher frequencies and maintaining stable cyclic operation.

Inside the explosion chamber, just before the orifices employed for oxidizer feeding, there is a protuberance or internal perimeter rib that determines a narrowing of the internal diameter of the explosion chamber, defining an annular volume which is fed exclusively with fuel through multiple distributors arranged in the rearmost zone of the explosion chamber. This constrained volume favors thermal interchange of the gases produced in the explosion with the cooled chamber wall and also allows an increase in the gas volume that acts as an insulating barrier between the gases involved in two consecutive explosive cycles, and in this way simplifies the maintenance of the pulsed process under the circumstance imposed by the high gas flow rates and high frequency that are the object of this patent.

In accordance with this operating scheme, after each ignition of the spark plug, the propagation of a shock and temperature wave generated by the explosive process, returns to the said constrained annular volume producing the combustion and decomposition of the fuel present in this volume, together with an overpressure that produces an interruption of the fuel feeding supply and even the penetration of the products of combustion via the distribution ducts. The high gas flow rates required in order to work at high frequencies cause this latter factor to be reduced so that new fuel is able to rapidly penetrate the explosion chamber via the distribution ducts, however, this effect is compensated by the presence of this constrained annular volume in the explosion chamber, the content of which in combustion products generates a sufficient amount of gas to act as an insulating barrier between the hot gases originated in the previous explosion and the new gases supplied to the explosion chamber.

The feeding of oxidizer begins in the zones closed to the ignition point (spark plug) to generate a local mixture poor in oxygen, with an injection in this zone of a maximum of 25% of the total volume supplied in each cycle, together with the local injection of the totality of fuel supplied to the explosion chamber.

The rest of the oxidizer is introduced into the explosion chamber in more advanced positions, closer to the tubular barrel, so that the combustion front that is produced at each spark plug ignition meets up with mixtures that are richer in oxidizer as it progresses along the explosion chamber, increasing its speed and energy, producing very energetic explosions that are suitable for the production of high quality coatings.

In this way, it is possible to produce, within the same chamber volume, and for the same explosive cycle, zones of greater and lesser energy. In particular, the new design of explosion chamber and the gas injection system favors the supply of energy to the zone closer to the oxidizer injection, and at the same time reduces the energy of the explosion in the rearmost zone of the explosion chamber, thus increasing the efficiency of the injection system in cooling the gases that accompany the retreating pressure wave and favoring the continuity of the cyclic detonation process at higher frequencies than with the previous devices.

According to a preferable construction, the oxidizer injector is concentrically and internally arranged in the explosion chamber, and has a prolongation at one end that extends practically to the gun's barrel, this prolongation incorporating a series of orifices obliquely arranged with respect to the gun's barrel, for the injection of oxidizer in this advanced location in the explosion chamber.

A second characteristic of the gun object of this invention, refers to the incorporation of a system for feeding products at any point of the barrel, a system that when it is used for the injection of coating powder permits an increasing of the amount of powder feed to the gun per unit of time, and therefore the amount of powder deposited on the substrate per unit of time, increasing also the gun's productivity.

For this reason, the barrel comprises an annular chamber at an intermediate point of the barrel, assisted by one or more material feeding inlets, so that the product introduced through them reaches the inside of the barrel with an annular distribution achieving a good mixture with the gases that are present in the barrel and avoiding the formation of high concentrations of material in specific zones, just as occurs with traditional injectors consisting of radial orifices.

The employment of this type of feeding ducts for the injection of the coating powder permits good distribution of the powder because, instead on entering the barrel through a single point, it does so through the annular chamber and consequently in a more homogeneously distributed manner, reducing the volumetric density of powder injected per unit of area, reducing the problems of blockages, but, in addition, allowing a larger amount of powder to be introduced into the gun.

In accordance with another characteristic of the invention, it has been planned for the mentioned annular chamber to take the form of a flange that divides the chamber in two segments, to allow the flange to be dismounted for injection duct maintenance and the front part of the barrel corresponding to the exit mouth in order to replace it with one having different characteristics, so that the same gun may have several configurations, including various lengths that allows coatings with different materials that require greater or less thermal and/or kinetic energy and hence a longer or shorter barrel.

In a similar fashion, it is also possible to connect segments of barrel having different diameters according to the type of coating powder used or the special characteristics of the current process or application.

It has also been planned for the flange that incorporates the annular injector to be coupled to the gun by means of a device that allows the separation between the flange and the barrel to be varied to established and entrance of external air between the two parts, and even to make one part independent from the other, so that on certain occasions the performance and results of the gun can be improved.

In accordance with another of the invention's characteristics, it has also been planned that the flange comprises a second annular chamber, with its corresponding inlets for feeding material and which opens to the inside of the barrel and chamber to allow the injection of a product of the same or different characteristics of the one introduced via the main chamber. Specifically, it is possible to introduce powders of different types or to distribute the powder feeding along the length of the barrel, which will permit to obtain a greater versatility in the composition of the coatings obtained.

It is also possible to use the mentioned annular feeding system for the injection of active gases, in such a way that it would be possible to locally modify the nature of the mixture conditioning the explosive process, so, for example, these active gases may modify the energetic characteristics of the actual spraying process itself, modifying the temperatures and speeds applied to the sprayed particles or they can also provide a thermochemical environment that conditions the reactive interaction between these gases and the particles to be deposited, or even produce the synthesis of the materials deposited during the spray process.

Of course, the described annular injector may be single, double or multiple, comprising one or several product feeding inlets and one or more injectors of this type can be distributed along the barrel.

Therefore, by means of the proposed feeding system, it is possible to voluntarily modify the gun's working conditions, since it is possible to inject all types of products that may modify, both the spray process conditions and the coating composition, and this injection may be made at any point of the barrel and so, as already mentioned, the dimensions of the barrel may be rapidly and simply changed, achieving an enormous flexibility in the gun's operation and consequently in its capability of processing a wide range of material.

It is also possible to use the described annular injector for the introduction of an inert gas to reduce the transfer of heat between the gases produced in the explosion and the cooled wall of the barrel, thus making use of these gases to best advantage.

In accordance with this structure, the gases produced in the explosion progress along the central zone of the barrel in its output sector, while the gases injected by means of the cited annular chamber flow in contact with the barrel wall, forming a kind of moving cylindrical film that reduces the heat losses of the gases produced in the explosion through contact with the cooled tube that forms the barrel and which determines greater performance from the gun.

In addition, the film of surrounding gases form at the mouth of the barrel what could be called a virtual barrel, that axially lengthens the size of the actual barrel itself, reducing and delaying the mixture of the explosive process products with the gases in the environment, which leads to the fact that with a shorter, lighter barrel, the powder particles are better melted and this produces a coating with better properties.

When using easily oxidized powders, it is possible to carry out the injection with an inert gas, so that the powder is protected from the environmental air by being surrounded by this gas and consequently, the quality of the produced layer or coating is improved.

DESCRIPTION OF THE DRAWINGS

To complete the description that is being made and for further understanding of the invention's characteristics, in accordance with a preferable practical example of the same, a set of drawings is provided as an integral part of the said description, where the following has been represented with an illustrative and non-limiting character.

BEST MODE FOR CARRYING OUT THE INVENTION

Figure 1:
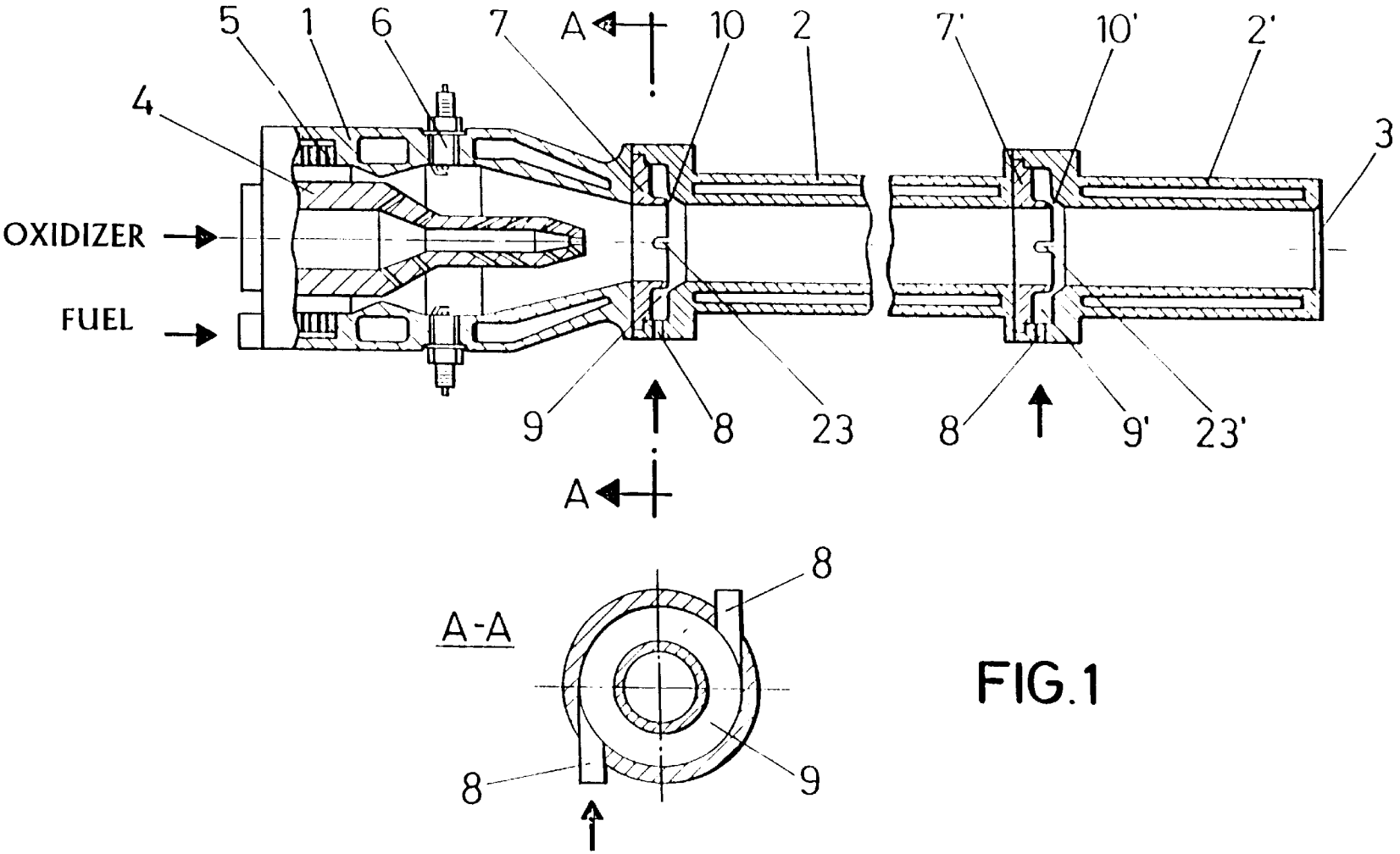
FIG. 1. Shows an schematic representation in section of the gun which is the object of this invention and which also shows a transverse section of one of the annular material injectors that is incorporated into the barrel.

In view of these drawings, one can see how the gun object of the invention comprises an explosion chamber (1) and a barrel (2) of suitable length, open at one end (3) and closed at the other, and which is made up of one or more segments (2), (2'), joined by flanges (7), (7') that can incorporate entrances for products.

The explosion chamber (1) comprises the fuel injector (5), the oxidizer injector (4) and the spark plug (6) for the ignition of the fuel-oxidizer mixture obtained in the explosion chamber. In addition, it incorporates the connectors that correspond to a gun cooling circuit (not represented), for example, using water.

Figure 2:
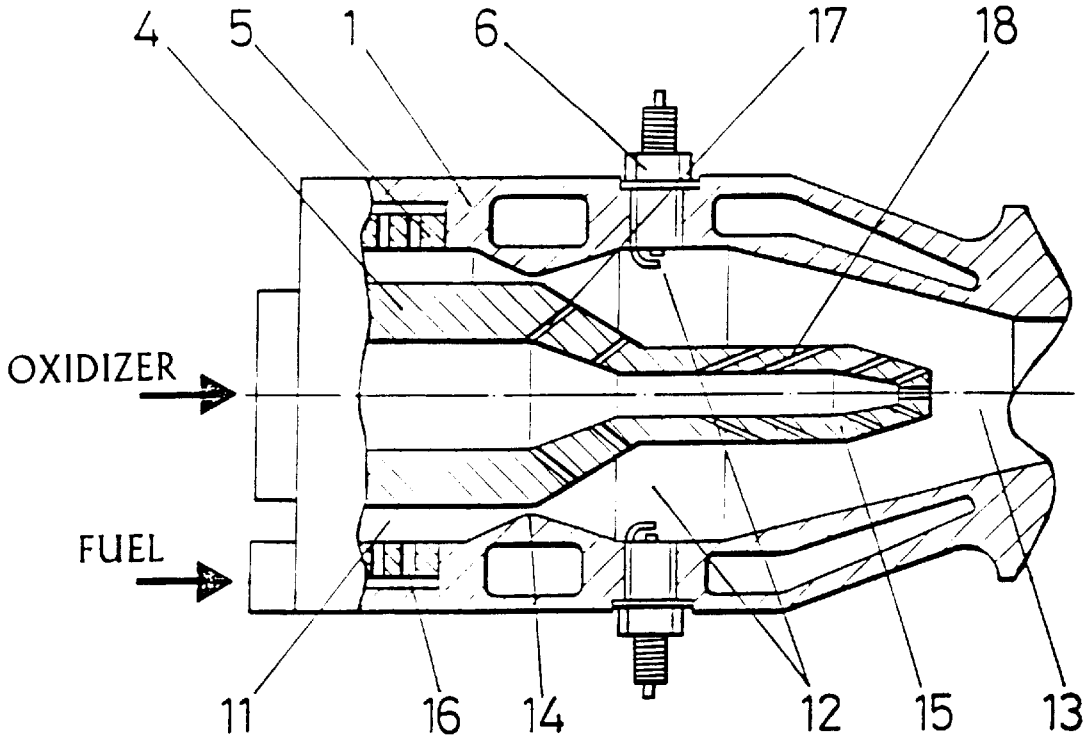
FIG. 2. Shows a section of the invention's detonation gun's explosion chamber, indicating the new gas injection system for generating mixtures of different composition in various zones of the chamber.

As can be seen from FIG. 2, the explosion chamber (1) comprises in the rearmost zone, just before the orifices (17) used for oxidizer feed, a protuberance or internal perimeter rib (14) that determines a narrowing that defines an annular volume (11) into which the fuel is introduced exclusively and which is fed via the orifices (16) located in a bushing that is concentric to the explosion chamber, or in the actual walls (5) and which open into this chamber at the most rearwards position (11) prior to the rib (14).

One of the main characteristics of the gun of the invention refers to the fact that it incorporates an oxidizer feeder (4) (for example, oxygen) arranged concentrically and internally to, the explosion chamber (1), with a prolongation at one end that extends practically to the zone that communicates with the gun's barrel (13) incorporating a multiplicity of orifices (17), (18) for feeding the oxidizer, for example, oxygen, which allows the feeding of this oxidizer to various locations distributed throughout the explosion chamber.

Specifically, a first series of oxidizer (for example, oxygen) feeding orifices (17) has been provided in a first location close to the ignition zone (12), where the prolongation (15) of the feeder (4) incorporates other oxidizer feeding ducts (18) along its length that are employed to progressively enrich the mixture during its advance towards the chamber zone that communicates with the barrel (13).

Another important characteristic of the invention refers to the fact that the gun's barrel (2) incorporates one or more expansion and distribution annular chambers (9) with their corresponding products feeding inlets (8), chambers (9) that open to the inside of barrel (2) via annular outlets (10) directed towards the barrel's exit.

Figure 3:
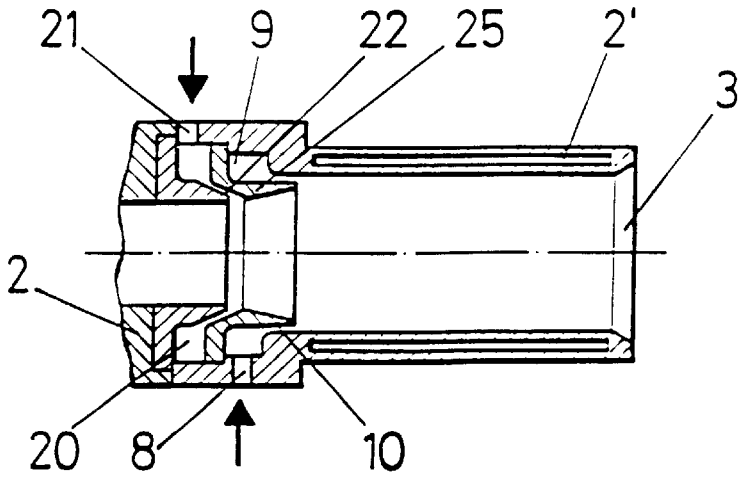
FIG. 3. Shows a partial view of a material injector incorporated into the barrel corresponding to a variation where the annular injector also incorporates an auxiliary product entrance. In addition, it shows a variation of the flange that incorporates the said injector to permit the connection of two-barrel segments with different diameters.
Figure 4:
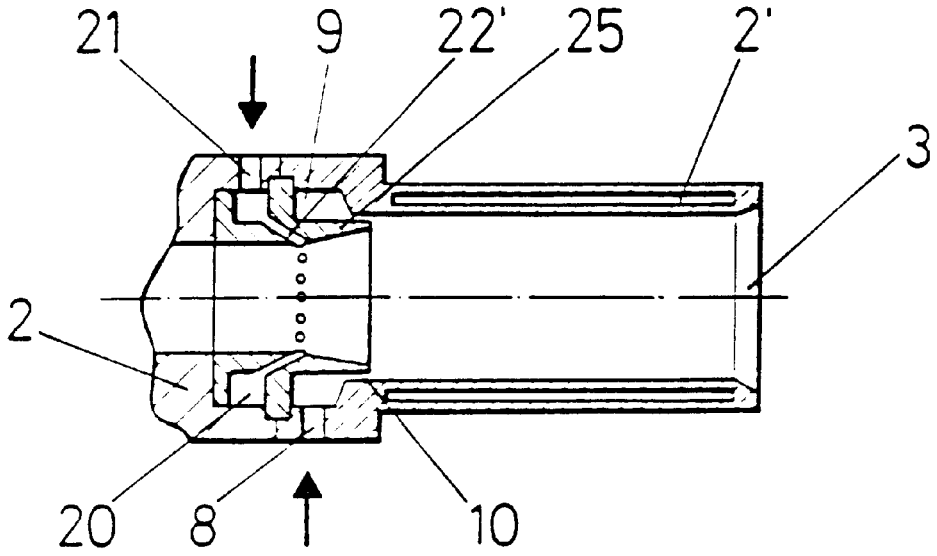
FIG. 4. Shows a variation of the view given in FIG. 3 where the material exits present a multiplicity of orifices that open out to the inside of the barrel.

The annular chambers (9) are established within the flanges (7), independently of the barrel (2) and can be fixed to it by any method, so that these flanges (7), together with the barrel's segment or segments (2), (2'), can be substituted or replaced, having several barrels for a single gun, including various lengths or diameters, which, in addition, permits greater ease during maintenance operations of the injection ducts, which allows the operational features of a single gun to be substantially modified, using the most suitable configuration for each case. FIGS. 1 and 6 represent a barrel with a terminal segment (2') of the same diameter as the first section (2), whereas FIGS. 3 to 5 show a barrel where the terminal segment (2') has a greater diameter than the first section (2).

Figure 5:
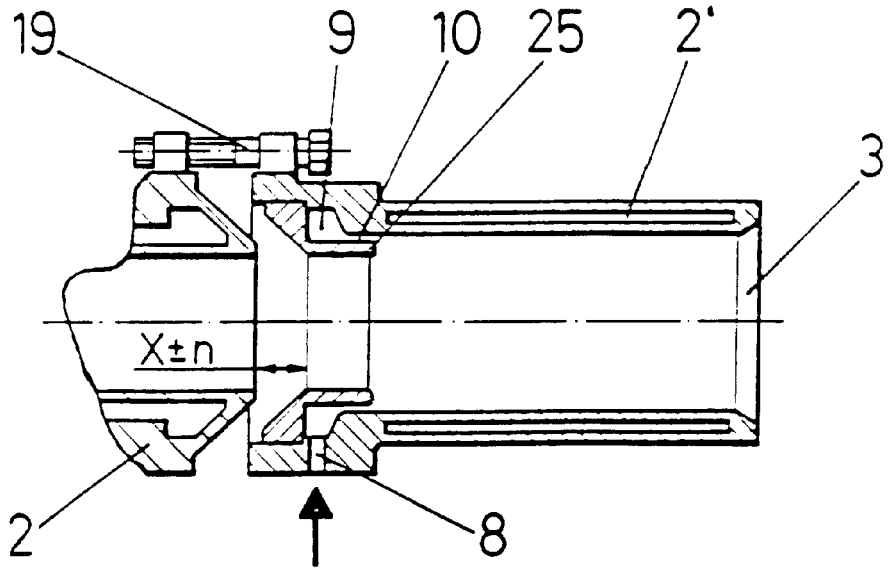
FIG. 5. Shows a representation of the flange that houses the annular injector comprising separator means that allow the distance between the flange and a segment of the barrel to be varied, this providing an adjustable separation between the two parts for the entrance of outside air.
Figure 6:
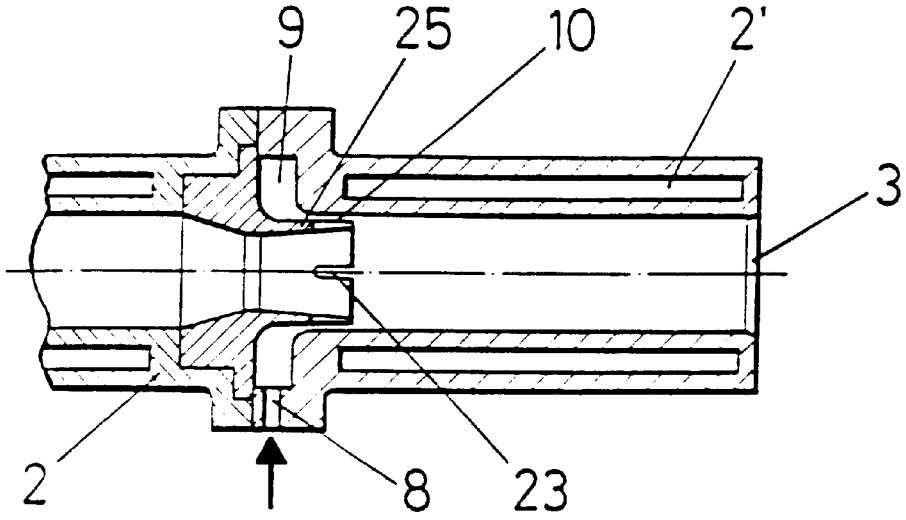
FIG. 6. Shows a variation of the annular injector with a diametrical reduction-expansion. It also shows a variation of this injector with longitudinal grooves.

In accordance with another characteristic of the invention, just as can be seen in FIG. 5, the flange (7) can incorporate a separator device (19) that permits the separation between the flange (7) and the initial sector (2) of the barrel to be modified, so that an adjustable separation may be established between them to allow the entry of outside air.

The feeding duct (8) may be employed for the injection of coating powder, thus achieving a good distribution of the same and minimizing the volumetric density of the powder introduced per unit of area, since instead of entering the barrel at a single point, it does so via chambers (9) and annular outlets (10) and consequently in a more homogeneous and distributed form.

The annular feeding duct can also be used for the injection of active, reactive or neutral substances, such as, for example, fuel, oxygen air or nitrogen etc, in this way modifying the conditions of the actual thermal spray process itself and making it possible to modify the parameters based on the injection of various products at different points inside the barrel.

As from this basic structure and in accordance with FIGS. 3 and 4, it is possible to incorporate, in the same flange (7), in addition to the already mentioned annular chamber (9), a second annular chamber (20), with its corresponding inlet (21) and outlet (22) ducts, designed to make up an auxiliary products inyector, which may be the same or different to those injected via the main feeding chamber (9) and therefore, for example, it would be possible to inject different powders in order to form coatings with two or more different materials.

In addition, and as can be perfectly seen in the cited FIGS. 3 and 4, the diameter of the barrel segment (2') is greater than that of the first segment (2), and more specifically, the second segment (2') diameter coincides with the external or maximum diameter of the annular outlet (10') of the chamber exit, also annular (9), at the same time being larger than the internal diameter of the first segment (2) of the said barrel, with which, as already said and in accordance with the invention's object, the injection of a gas via the entrance (8), emerges from the annular outlet (10) forming a kind of film which is also annular and established between the actual barrel wall itself (2') and the hot gases produced in the explosion, making contact between them and the cooled barrel difficult and consequently allowing a reduction in the energy losses.

In FIG. 1, the flange (7) allows the connection of the two segments of the barrel (2, 2') of the same diameter, where it is also possible to make this connection with the layout shown in FIG. 6, where two sectors (2, 2') of the barrel with the same diameter are connected by means of a progressive reduction of diameter in the terminal zone of the first section (2) of the barrel, and of a posterior progressive expansion in correspondence with the output outlet (10) of the annular chamber (9).

As can be seen in FIG. 4, one of the barrel access outlets (22') can be made, instead of being a continuous annular slot, through a series of orifices, arranged approximately in a ring. Also shown in FIGS. 1 and 6 is the presence of longitudinal slots (23) in the outlets (10) with the function of increasing the amount of powder that may be processed by the said components. These configurations may be used at any of the outlets of any of the material injectors incorporated into the gun.

Figure 7:
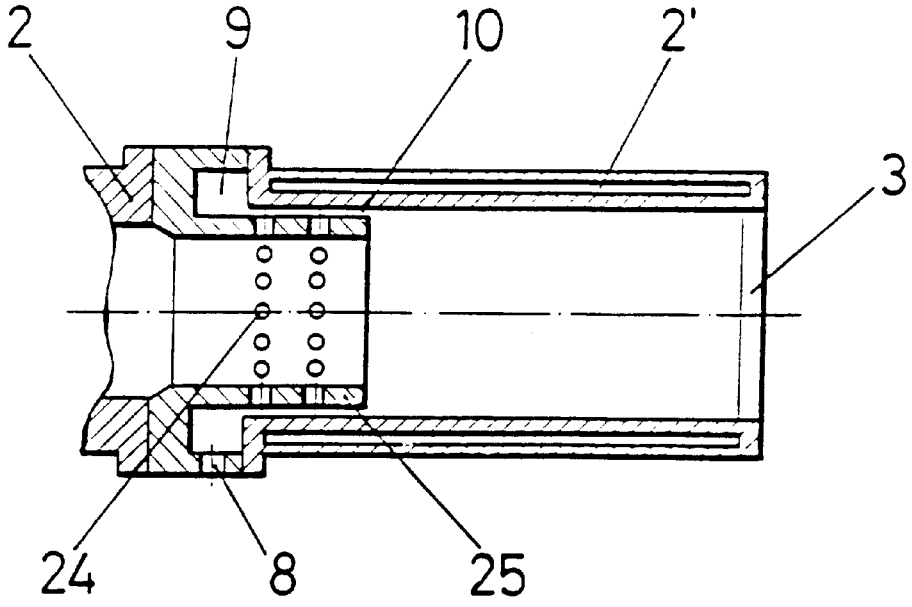
FIG. 7. Shows a variation of the annular injector where the outlet in communication with the barrel is fitted with a multiplicity of radial orifices and an axial feeder ring.

In FIG. 7, the outlet (10), in addition to presenting an annular axial communication with the barrel, includes a multiplicity of orifices (24) along its length, which open radially on the inside of the barrel and allow the product feeding to be performed in a more distributed manner. This configuration may be used at any of the outlets of any of the material injectors incorporated into the gun.

The outlets (10) that communicate the annular chambers (9) with the inside of the barrel (2) are configured as ducts formed by the internal wall of the barrel and by an axial rib (25) in the flange (7), which, on the one hand, permits the correct distribution of the material inside the barrel and, on the other, regulates the interaction between the gases produced by the explosions and the materials supplied in the annular chambers (9). The outlets may be configured as annular ducts that are variable in longitude and section in combination, or not, with radial ducts of the type represented by the orifices (24) and the slots (23). Ultimately, the geometry of the outlet (10) is determined by the characteristics of the product injected into the barrel and by the properties of the coating to be achieved. For example, if the material fed into the barrel is a gas and it is to be used to insulate the gases produced in the explosion from the cooled walls of the barrel, then the most suitable outlet would have a configuration similar to that numbered (10) in FIG. 6. On the other hand, for feeding a material in the form of powder, an outlet configuration such as that represented in FIG. 7 is more appropriate.

What is claimed is:

1. A detonation spray gun with a high firing rate frequency and high productivity, comprising:

an explosion chamber having a length and a barrel having a length, to which is directly and separately supplied fuel and an oxidizer, an ignition system for generating gases produced in an explosion process that drag a coating material; fed into the barrel and which is then sprayed towards a piece to be coated, means for feeding the fuel and oxidizer into the explosion chamber to produce explosive mixtures of varying compositions depending on zones within the explosion chamber in such a way that there is generated, within the same explosion chamber and for the same explosive cycle, zones with greater or lesser energy, and means for the distributed feeding of products into the barrel to obtain high volumes of feed and suitable mixtures of the gases present in the barrel, where the position of said means for distributed feeding along the length of the barrel is selected and modified by a user, for the injection of products at any point in the barrel.

2. A detonation spray gun as in claim 1, wherein the means for feeding the oxidizer further comprises multiple oxidizer injection points that are spatially distributed along the length of the explosion chamber, wherein the means for feeding the fuel further comprises multiple fuel injection points located in a rearmost zone of the explosion chamber, said oxidizer and fuel injection points generating a mixture that is rich in fuel close to an ignition zone in the explosion chamber and progressively increasing the percentage of oxidizer in zones close to the connection of the explosion chamber with the barrel.

3. A detonation spray gun as in claim 2, wherein the explosive mixture generated in the ignition zone is a maximum of 25% of the oxidizer and 100% of the fuel supplied to the explosion chamber in each cycle.

4. A detonation spray gun as in claim 2, wherein the explosion chamber incorporates, between the the oxidizer injection points and the fuel injection points, an internal protuberance that determines a narrowing of the explosion chamber forming a constrained volume which is exclusively fed with fuel via the fuel injection points.

5. A detonation spray gun as in claim 4, wherein the means for feeding the oxidizer comprises an axial injector arranged concentrically and internally to the explosion chamber with a first series of radial orifices placed outside the constrained volume and immediately after the internal protuberance, said axial injector including at one end a prolongation extending to the beginning of the barrel and provided with a second series of radial orifices, these said radial orifices being arranged along the length of the explosion chamber.

6. A detonation spray gun as in claim 5, wherein the radial orifices and for the oxidizer feeder are arranged obliquely with respect to an axis of the barrel.

7. A detonation spray gun as in claim 1, wherein the means for distributed feeding of products into the barrel consist of one or more annular chambers established in the barrel; and assisted by one or more product feeder inlets (8), where the one or more annular chambers have outlets for passage at products to the barrel in a distributed manner.

8. A detonation spray gun as in claim 7, wherein the outlets are configured as annular ducts with variable length section and orientation.

9. A detonation spray gun as in claim 7, wherein the one or more annular chambers are established in one or more moveable flanges mounted in the barrel, said one or more flanges defining physically independent segments of the barrel.

10. A detonation spray gun as in claim 7, wherein the outlets are configured as ducts defined between an internal wall of the barrel and an axial rib of the flanges.

11. A detonation spray gun as in claim 10, wherein the axial rib presents an enlarged length that is superposed on the interior of the barrel in such a way that when the injector is used for the introduction of an inert gas, the explosion gases progress along a central zone of the barrel, while the inert gas flows in contact with the barrel wall, forming a moveable, cylindrical film that reduces the heat losses through the barrel walls and defines at the exit of the barrel a protective film, which reduces and delays the mixture of the products from the explosive process with the gases of the environment.

12. A detonation spray gun as in claim 9, wherein the one or more movable flanges comprise a further annular chamber, placed before the one or more annular chambers, and provided with further inlets ducts which open out on the interior of the barrel immediately in front of the outlet of the one or more annular chambers, and being designed to provide a second feeding point for the supply of product to the barrel.

* * * * *